United States Patent [19]

Levasseur

[11] 4,359,147

[45] Nov. 16, 1982

[54] MEANS TO CONTROL VENDING FUNCTIONS

[75] Inventor: Joseph L. Levasseur, Chesterfield, Mo.

[73] Assignee: H. R. Electronics Company, St. Louis, Mo.

[21] Appl. No.: 63,782

[22] Filed: Aug. 6, 1979

[51] Int. Cl.[3] ..... G07F 9/02

[52] U.S. Cl. ..... 194/1 N; 221/13; 221/15; 221/21

[58] Field of Search ..... 221/2, 8, 9, 13, 15, 221/21, 124–126, 133, 123, 6; 194/1 N, 1 R, 2, 10; 250/223 R, 222 R

[56] References Cited

U.S. PATENT DOCUMENTS

| | | | |
|---|---|---|---|
| 3,219,234 | 11/1965 | Wichman | 221/6 |
| 3,228,553 | 1/1966 | Breiteustein et al. | 221/6 |
| 3,687,255 | 8/1972 | Johnson | 194/1 N |
| 4,008,792 | 2/1977 | Levasseur et al. | 194/10 X |
| 4,034,839 | 7/1977 | Lee | 194/10 |
| 4,108,333 | 8/1978 | Falk et al. | 221/13 |
| 4,225,056 | 9/1980 | Flubacker | 194/1 N X |

FOREIGN PATENT DOCUMENTS 860774 1/1971 Canada .

*Primary Examiner*—F. J. Bartuska
*Attorney, Agent, or Firm*—Haverstock, Garrett & Roberts

[57] ABSTRACT

An improved vending control system for controlling events and sequences of events involved in vending and paying out or refunding of amounts deposited, the system including product delivery sensing apparatus to monitor the delivery of products and to indicate when a product dispensing cycle has been successfully completed, the sensing apparatus including a sensor device located to sense the dispensing of all products, circuits connecting the sensor device to produce outputs whenever a product being delivered is sensed, a timing device for establishing a predetermined time interval whenever a product delivery operation is initiated, and a comparator circuit to compare the time of occurrence of an output of the sensing apparatus to the predetermined time interval to control terminating a vend cycle and the subtracting of the price of a vend from an amount of credit entered by the customer. The present control system also includes other apparatus operable when no effective product delivery is sensed during the predetermined time interval to inhibit subtracting of the vend price from the credit entered and to terminate the vend cycle, the other apparatus including circuit elements operable to enable the customer to make an alternative selection or to receive a refund of the credited amount. The present system may optionally also include a memory circuit in which information is stored to indicate when a particular selected product has failed to be delivered to inhibit and prevent future selections of the same product and to record the particulars of the product delivery failure.

22 Claims, 5 Drawing Figures

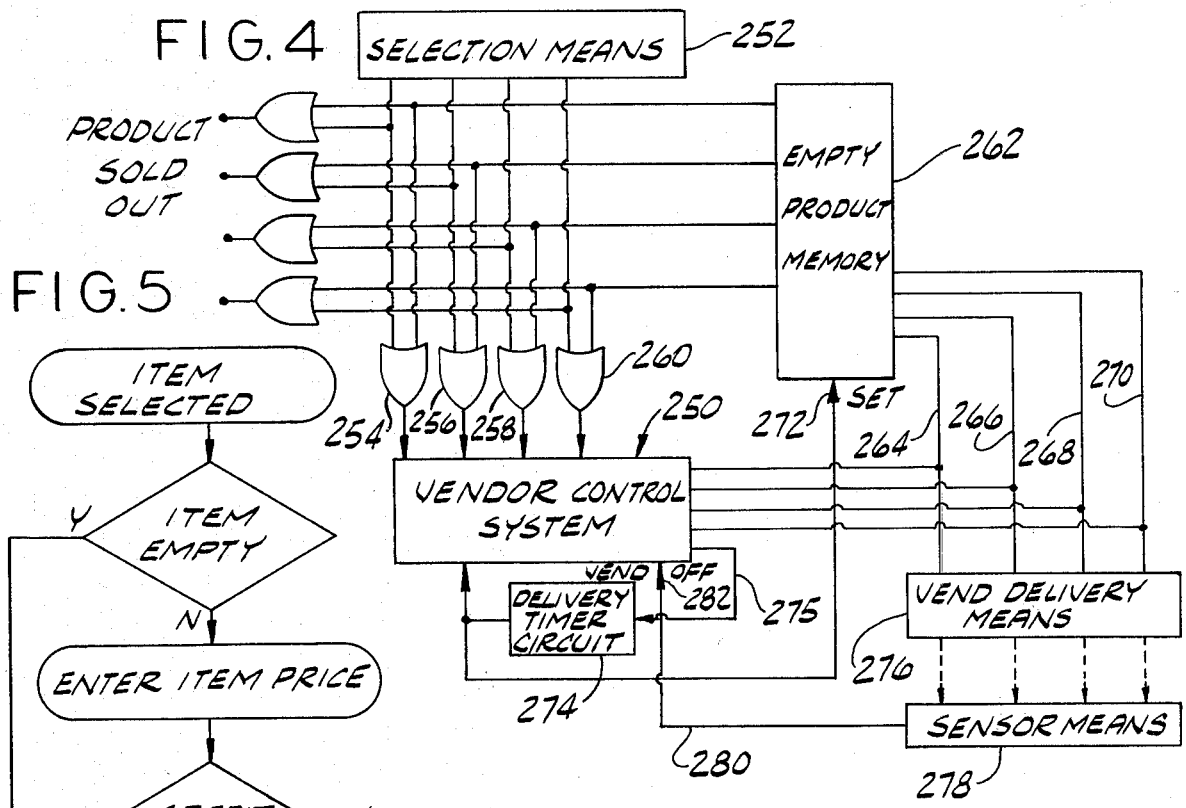
FIG. 4
SELECTION MEANS
252
PRODUCT SOLD OUT
EMPTY PRODUCT MEMORY
262
260
254
256
258
250
SET
272
264
266
268
270
VENDOR CONTROL SYSTEM
VEND
OFF
282
275
DELIVERY TIMER CIRCUIT
274
VEND DELIVERY MEANS
276
SENSOR MEANS
278
280

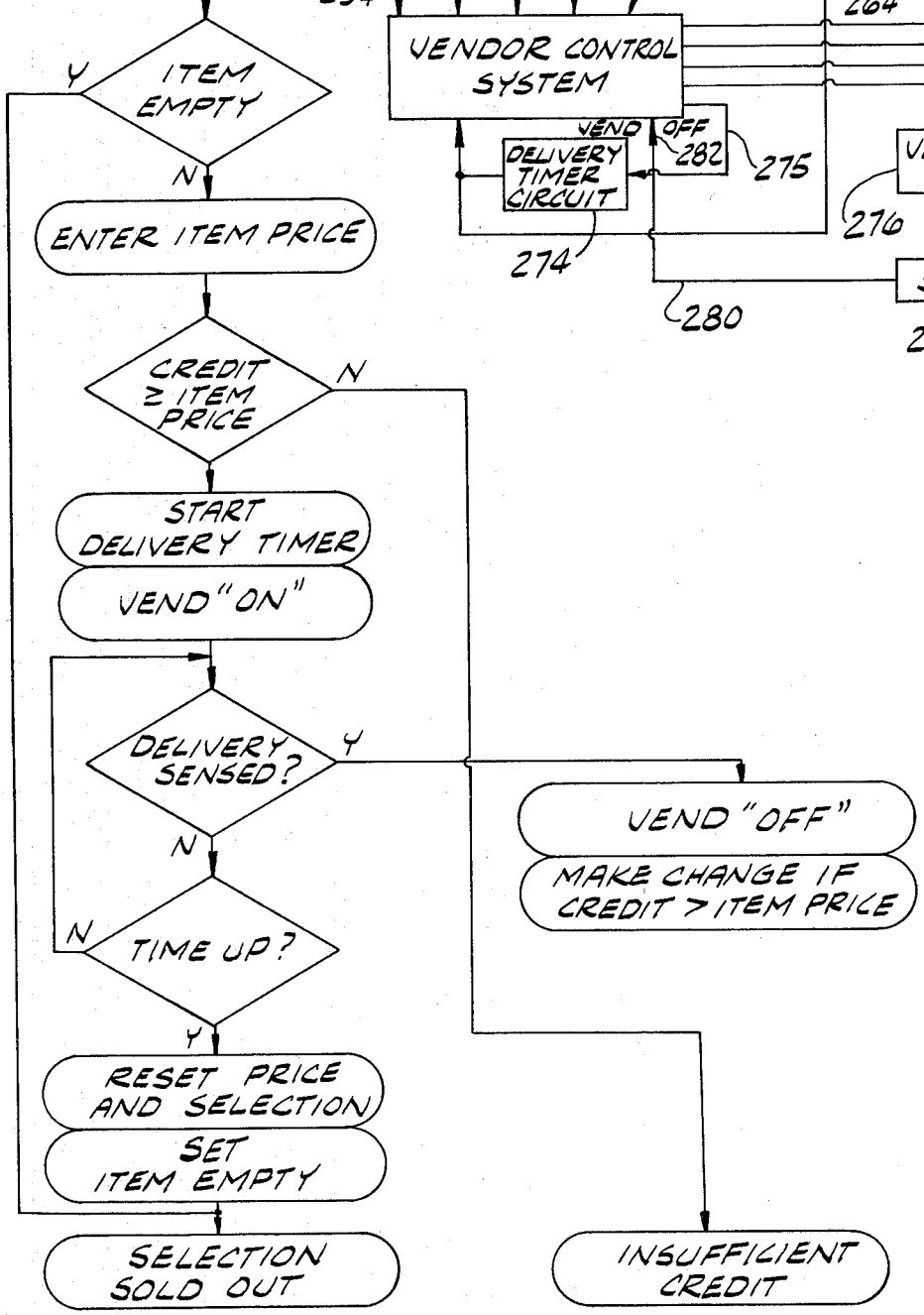
FIG. 5
ITEM SELECTED
ITEM EMPTY
Y
N
ENTER ITEM PRICE
CREDIT ≥ ITEM PRICE
N
START DELIVERY TIMER
VEND "ON"
DELIVERY SENSED?
Y
N
TIME UP?
N
Y
RESET PRICE AND SELECTION
SET ITEM EMPTY
SELECTION SOLD OUT
VEND "OFF"
MAKE CHANGE IF CREDIT > ITEM PRICE
INSUFFICIENT CREDIT

MEANS TO CONTROL VENDING FUNCTIONS

The present invention is described as an improvement over the device disclosed in Levasseur U.S. Pat. No. 3,894,220 which issued July 8, 1975 and is assigned to Applicant's assignee. It is to be understood, however, that the subject improvements can also be used in conjunction with other vend control circuits and systems and is not limited to use with any particular circuit or system. Typical other control devices with which the present improvements can be used include the vend control devices disclosed in U.S. Pat. Nos. 3,687,255 and 4,008,792, also assigned to Applicant's assignee.

In the patented constructions shown in U.S. Pat. No. 3,894,220, and in others, the vend delivery means for a multi-product vending machine requires a plurality of vend motors, one for each product, each having associated with it a cam operated switch or like device. When a vend cycle takes place a selected one of the motors is energized and its associated cam switch is operated. In the patented construction the vend motors are motors 130, 131, 133 and 135 and their respective cam operated switches are 130A, 131A, 133A and 135A. Each time one of the cam switches is opened it interrupts a circuit to and through a vend delivery interface circuit 134, and this is true regardless of which vend motor is energized. Before a vend cycle can occur, the vend payout control logic circuit 72 must establish the necessary conditions therefor. A vend can only take place in the patented construction when the amount deposited or credited to the customer at least equals the vend price established by pricing means such as by pricing matrix circuit 54. This means that with the patented construction for each possible vend there must be a separate vend motor, a separate motor cam switch, and other circuit features all of which substantially complicates the construction, increases its cost, and requires that the device have a relatively large number of mechanical or electromechanical devices making the known circuits relatively expensive to construct and trouble prone.

The present construction overcomes these and other disadvantages and shortcomings of the patented constructions and teaches a construction which requires a single switch or other vend delivery sensing device positioned to respond to any and all product deliveries regardless of the number of possible vends and vend motors. The present circuit also includes means for resetting the vend control means when no product delivery is sensed to enable the customer to make another selection or to get his money back, and the system includes means for establishing a predetermined time interval for product delivery which will not be interrupted if the particular vend delivery means or motor has already been energized even though no product is actually delivered.

The present improved means may also include a feature that prevents further selections of a particular product or service if the vend motor for that product or service should be energized but should fail to make a delivery for any reason, and the present system may optionally include means to provide visual or other easily recognizable outputs to indicate when a selection is made and when a vend delivery is ineffective.

The present improvements are also adaptable to being embodied in a circuit in association with a microprocessor and such is described herein.

It is therefore a principal object of the present invention to teach the construction and operation of a relatively simple and inexpensive vending control system and particularly such a system having multi-product capability.

Another object is to substantially reduce or eliminate many of the more costly and troublesome components of vending control systems.

Another object is to teach the construction and operation of improved means for monitoring certain functional operations of a vending machine.

Another object is to establish a predetermined time interval during which certain functions of a vending machine such as the vend of an article are normally expected to take place.

Another object is to provide additional options and safeguards for customers of vending machines especially under circumstances where a particular article or product becomes unavailable for some reason such as because of a jam, a misfeed, or the supply of a product runs out.

Another object is to give a customer of a vending machine the options of selecting an alternate product or getting his money back when a product selected is unavailable or unable to be delivered for some reason.

Another object is to facilitate the use of microprocessors and like devices in the control of vending and like machines.

These and other objects and advantages of the present invention will become apparent after considering the following detailed specification in conjunction with the accompanying drawings, wherein;

FIG. 4 is a simplified block diagram of a vend control system incorporating the present improvements; and FIG. 5 is a logical sequence of events or flow chart for the present invention.

Figure 1:
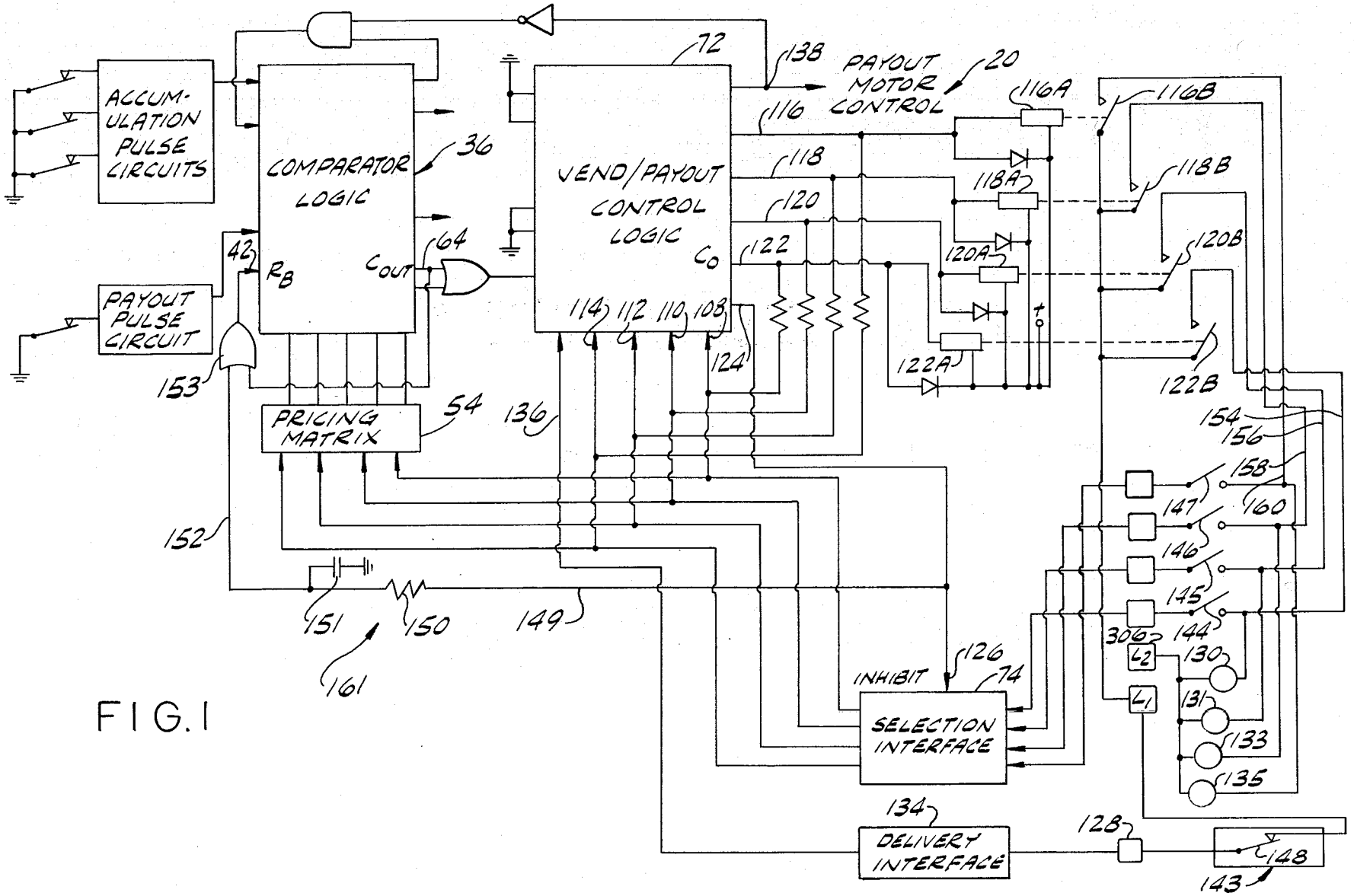
FIG. 1 is a circuit diagram partly in block form showing the more important components and their interconnections in a vend control circuit that embodies some of the teachings of the present invention.

Referring to the drawings more particularly by reference numbers, number 20 refers to a vend control circuit incorporating teachings of the present invention. FIG. 1 is similar in many respects to FIG. 1 of U.S. Pat. No. 3,894,220, and the description of FIG. 1 in the patent is incorporated herein by reference. The subject improvements can also be incorporated into other known vend control circuits including, but not limited to, those disclosed in U.S. Pat. Nos. 3,687,255 and 4,008,792. All three of the named patents are assigned to Applicant's assignee.

FIG. 1 includes features not disclosed in FIG. 1 of U.S. Pat. No. 3,894,220. In particular, those features of FIG. 1 which differ from the patent construction include the provision of leads 154, 156, 158 and 160 which connect the vend relay switches 122B, 120B, 118B and 116B to the respective customer selections switches 144, 145, 146 and 147 and to the respective vend motors 130, 131, 133 and 135. The connections between the switches 122B–116B and the respective inputs to the selection interface circuit 74 are eliminated in the present construction for reasons which will become apparent. Furthermore, in the improved circuit construction, the cam operated series connected vend motor switches are eliminated and replaced by a single switching device 148 which is part of a sensor device 143 located on or in association with the product delivery means or chute so as to produce a response whenever any of a plurality of products is delivered to the customer regardless of which vend motor is energized. In other words the sensor means 143 and associated switch device 148 are not connected to, or operated by, the vend motors in any direct sense as in the prior devices but is located to sense each vend so as to produce a corresponding response. The sensor that controls operation of the switch device 148 can be a photoelectric sensor, a magnetic sensor, a mechanical or electromechanical sensor, a piezo-electric sensor, an optical sensor, or even an acoustic sensor. This means that with the present construction, it is no longer necessary to have a plurality of individual motor operated cam switches such as the switches 130A–135A which are connected in a series for individual operation by the respective vend motors. This is an important difference which produces advantages from the operational, cost, and maintenance standpoints. This also substantially reduces the number of necessary components in multi-product or multi-service vending devices, substantially simplifies the structure thereof, increases the circuit versatility and makes it easier to embody in a more totally electrical circuit. This is possible with the present improved circuit without the loss of any operational features and with resulting operational and other advantages as will be explained. Furthermore, with the present construction there are no direct connections between the vend control circuit switches 116B-122B and the selection interface circuit 74, and hence there are no operational connections between the same switches and the pricing matrix 54 or between the same switches and the direct set inputs to the vend/payout control logic circuit 72.

With the present construction, when the customer after making an adequate deposit, actuates one of the selection switches 144–147, he establishes a circuit to energize the associated vend motor 130–135, and this in turn causes a signal to be applied to the respective input of the selection interface circuit 74. The outputs of the selection interface circuit 74, for the particular selected vend are applied to the pricing matrix 54 which applies the desired vend price to the price portion of the comparator logic circuit 36. The same signals at the output of the selection interface 74 are also applied as inputs to the vend/payout control logic circuit 72 which is the circuit that establishes a vend output on one of its output leads 116–122 to energize the associated vend solenoid or relay 116A–122A. When one of these relays is energized, its associated contacts 116B–122B close and establish a circuit which energizes the respective vend motor 130–135. These circuits are from power terminal $L_1$ through the closed contacts 116B–122B, to and through the corresponding vend motors 130–135, to the opposite input power terminal 306 also labeled $L_2$. It should be recalled that after the customer made his deposit, he pressed one of the selection switches 144–147 and this effected entry of the vend price into the comparator 36 and other information into the circuit 72 to energize the selected vend solenoid. At the same time the circuit 72 produced an output on lead $C_o$ at terminal 124. This is one possible way among many to produce a signal which can be used to indicate if any of several possible vend operations has begun. This signal operates to inhibit further vend selection by preventing the selection interface 74 from passing other signals therethrough. These same inhibit signals in the improved circuit are connected to a timer circuit 161 which establishes a predetermined time interval during which an effective vend operation will take place if it is going to take place. If during this preestablished time period no product is actually delivered even though a vend motor is energized and cycles, then it is important not to subtract the vend price from the amount deposited or credited to the customer. This is done so that the customer can get a total refund of his deposit or another selection. This means that with the present circuit the plurality of series connected individual motor cam switches are eliminated and replaced by a single sensor switch device 143 which has no operative connection to any of the vend motors, and the circuit operation has been modified so that the vend price is not subtracted from the deposit unless and until a product delivery is sensed.

To assure that the circuit operates properly, an important timing circuit 161 is provided to establish a predetermined time period during which vend delivery should take place if it is going to take place. The timing circuit 161 includes lead 149 which is connected to the inhibit output terminal 124 of the vend/payout control logic circuit 72. The lead 149 is connected to one side of resistor 150 which has its opposite side connected to the non-grounded side of capacitor 151 and to lead 152 which is connected as one of two inputs of an OR gate 153. The OR gate 153 has a second input connected to the $C_{out}$ terminal 64 of the comparator logic circuit 36. The output of the OR gate 153 is connected to the B reset input 42 of the comparator logic circuit 36. This means that the comparator logic circuit 36 is able to receive a B reset input by way of the OR gate 153 either on the lead connected to the $C_{out}$ terminal 64 of the comparator 36 or on lead 152. The signals present on the lead 152 are delayed due to the RC time constant provided by the resistor 150 and the capacitor 151, to allow time for the vend operation to complete itself. This is done so that the sensor device 143 will have an opportunity to sense the passage of a product and open the contacts 148 before the B or price portion of the comparator logic circuit is reset. It is important that the time interval established by the timing circuit 161, which is a measure of the total time required for vend delivery to be completed, be long enough so that the sensor means 143 will be able to sense any possible vend before resetting the circuit 36. This is done so that the customer will not lose the price of the selected vend and will be assured of getting another selection or a refund if the vend operation he selected should fail to deliver or be unable to function for some reason. This means that both the selection means and the vend price entry will be reset if no vend delivery occurs. If, on the other hand, the sensor device 143 senses a product being vended by opening the contacts 148 during the predetermined time period indicating the delivery of a product, then the price input portion of the comparator 36 will not be reset. This is because the opening of the sensor contacts 148 will produce a low condition through the delivery interface 134 to be applied to the first direct set input 136 of the vend/payout control logic circuit 72 to indicate that a vend has been completed as aforesaid. This in turn causes a high to be applied to the selection interface 74 and to the timer circuit 161 to return to a low condition so that the circuits can thereafter go through a normal change making function, if necessary.

The circuits which make this possible include leads 154, 156, 158 and 160 which are connected between the respective vend relay contacts 122B–116B and the respective customer actuatable switches 144–147 and the respective vend motors 130–135. These leads assure that if the respective selection switches 144–147 are not mechanically locked on when actuated by the customer, that releasing of the selection switch will not operate to interrupt the vend delivery means or the selected vend motor 130–135 until it has cycled. The circuit of FIG. 1 also eliminates the need for any connections between the vend relay switches 116B–122B and the inputs to the selection interface circuit 74 which means that all operative inputs to the selection interface 74 must be through one of the selection switches 144–147 by way of the associated vend motors 130–135 from the power input terminal 306 ($L_2$).

Thus, with the circuit of FIG. 1, when a customer actuates a particular selection switch 144–147 at a time when an adequate deposit has been made, he (1) produces a response at the corresponding input to the selection interface 74 which in turn (2) causes the pricing matrix 54 to feed the correct vend price to the B or price side of the comparator circuit 36, and (3) makes an entry into the vend/payout control logic circuit 72 to cause the corresponding vend relay 116A-122A to be energized. When the desired vend relay is energized, (4) its contacts 116B–122B close and establish a circuit through the corresponding lead 160–154 to (5) energize the corresponding vend delivery motor 130–135. At the same time that the selected vend relay 116A–122A was energized a signal was present on terminal 124 of circuit 72 and on lead 149 to (6) start the timer circuit 161 and initiate a predetermined time period of long enough duration to assure that the selected vend delivery will have time to be completed, and (7) to inhibit further operation of the selection interface 74 to prevent the passage of further price entry and product selection information. If during the predetermined time period established by the values of the resistor 150 and the capacitor 151, a product is in fact delivered, so that the normally closed contacts 148 of the sensor device 143 open, then in due course a signal will be applied through the delivery interface 134, to the direct set input 136 of the vend/payout control logic circuit 72 to terminate the vend cycle, subtract the vend price from the amount deposited, and initiate a payout operation, if necessary. A signal present on the direct set input 136, as stated, indicates that a vend has been successful, and as soon as the vend time interval produced by the timer circuit 161 is completed the output on lead 138 of the circuit 72 will go low for the purpose of initiating the change making operation, if one is required.

On the other hand, if a vend operation is initiated in the manner described so that the selected vend motor is energized and cycles, and a predetermined time interval is commenced but no vend delivery occurs during the time interval, the contacts of the sensor switch 148 will never open and no low signal will be applied to the direct set input 136 of the circuit 72. This means that the vend price previously entered into the B or price side of the comparator logic circuit 36 will be reset, and not subtracted from the amount of the deposit because of the application of a reset signal on the reset input 42. This prevents the customer from losing the vend price from the amount of his deposit when, for some reason, a vend was initiated but no product delivered. This allows for an alternate selection or a refund which ever is desired.

Figure 2:
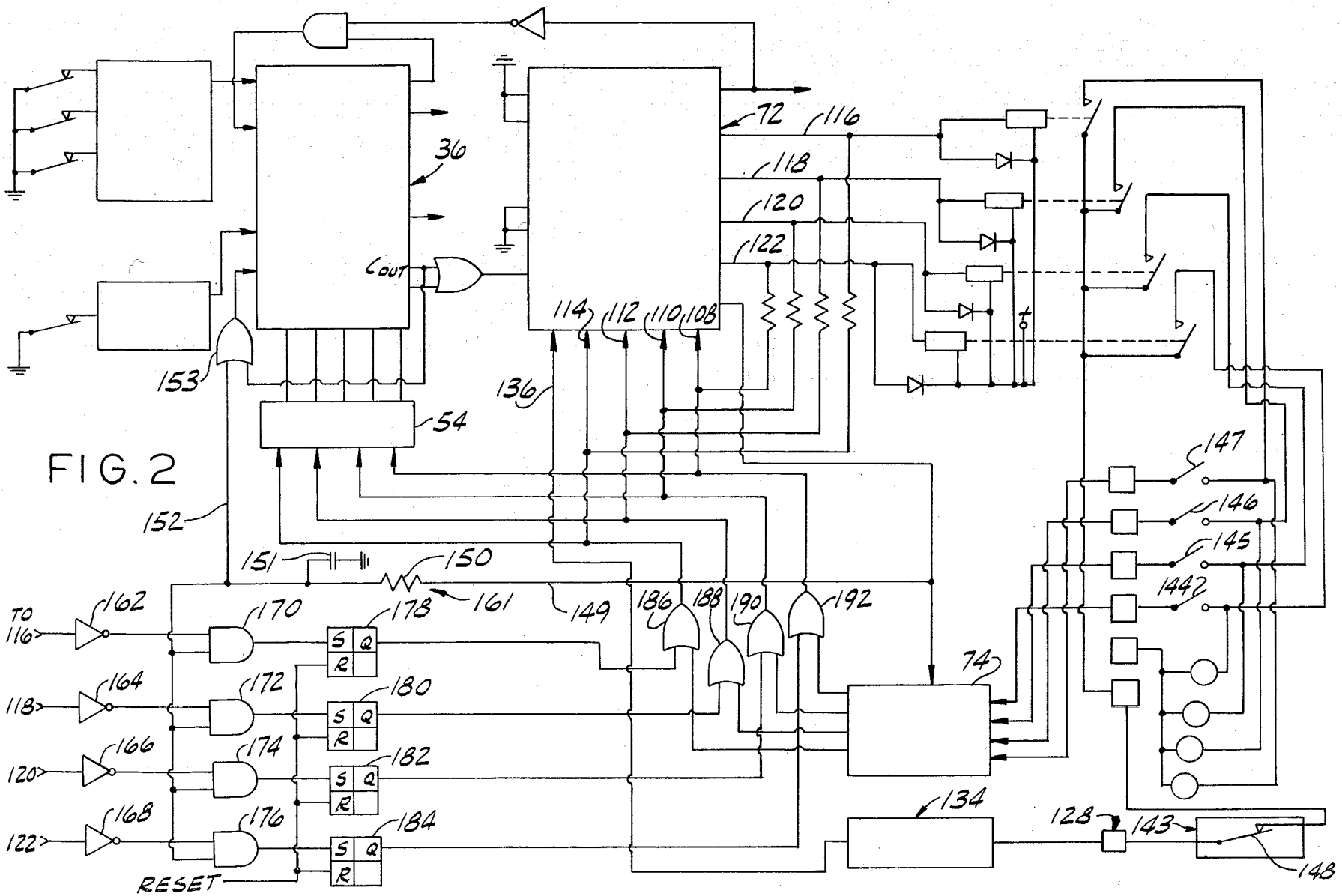
FIGS. 2 and 3 are circuit diagrams similar to FIG. 1 but modified to include additional features of the subject invention.

FIG. 2 includes all of the modifications and improvements of FIG. 1, and in addition includes other circuits which further increase the versatility and usefulness of the subject vend control circuit. In the circuit of FIG. 2, the outputs of the vend/payout control logic circuit 72 on the output leads 116–122, which are the leads used to energize the respective vend relays, are also connected respectively to inputs of inverters 162, 164, 166 and 168. The inverters 162–168 have their outputs connected respectively to inputs of AND gates 170–176, and the outputs of the AND gates 170–176 are connected respectively to SET inputs of flip-flops 178–184. The AND gates 170–176 also have other inputs that are connected in common and to the lead 152 on the output side of the RC timer circuit 161 described above. The Q outputs of the flip-flops 178–184 are, in turn, connected respectively to inputs of OR gates 186–192. The OR gates 186–192 have other inputs connected to the respective outputs of the selection interface circuit 74. The outputs of the OR gates 186–192 are connected as inputs to the pricing matrix 54 and to the direct set inputs to the vend/payout control logic circuit 72.

The purpose of the circuits just described is to prevent the customer from making further selections of a product that has failed to deliver when selected for some reason. There are many reasons a product delivery may fail including running out of the supply of that product, a jam in the product delivery mechanism, a defective vend relay or vend motor or some other related circuit failure. In each of these cases, a customer who fails to get delivery of the selected product will not lose money and will be able to make an alternate selection or get a refund of the total amount of his deposit as already described. In some known devices, flip-flops or like memory elements are associated with each product selection mechanism and have been used to provide an indication such as by energizing a light to indicate product unavailability. However, no known device includes means in the vend control circuit such as shown and described herein which function is to assure that a customer will not suffer a loss if he selects a product that is not available for some reason, and no known circuit uses a single product delivery sensor means such as the sensor means 143, positioned and connected as shown and described and used in association with a timer circuit. This means that when the AND gate 170–176 which corresponds to the particular vend control line 116–122 that was activated, will operate to cause an associated flip-flop 178–184 to be set to prevent a customer from making effective future selections of the product that failed for some reason to delivery. This is accomplished by way of the associated gates 186–192. For example, if the flip-flop 178 is set by an output from the AND gate 170, it will establish a high on one of the two inputs to the OR gate 186, and this high condition will prevent a low from occurring thereafter on its output even when the corresponding selection switch 147 is activated. This condition will remain until the condition that caused the vend delivery failure has been corrected, and this usually requires some action by a repair or service person. Since the direct set input leads 108–114 and 136 to the circuit 72 are set by being in a low state, the presence of a high state thereon, as indicated, will prevent future settings from happening in the corresponding position. The advantages of this type of operation are readily apparent and are important to prevent the possibility of further effective selection of an article that is either not available or incapable of being delivered, and to prevent the customer from losing money during a vending operation.

Figure 3:
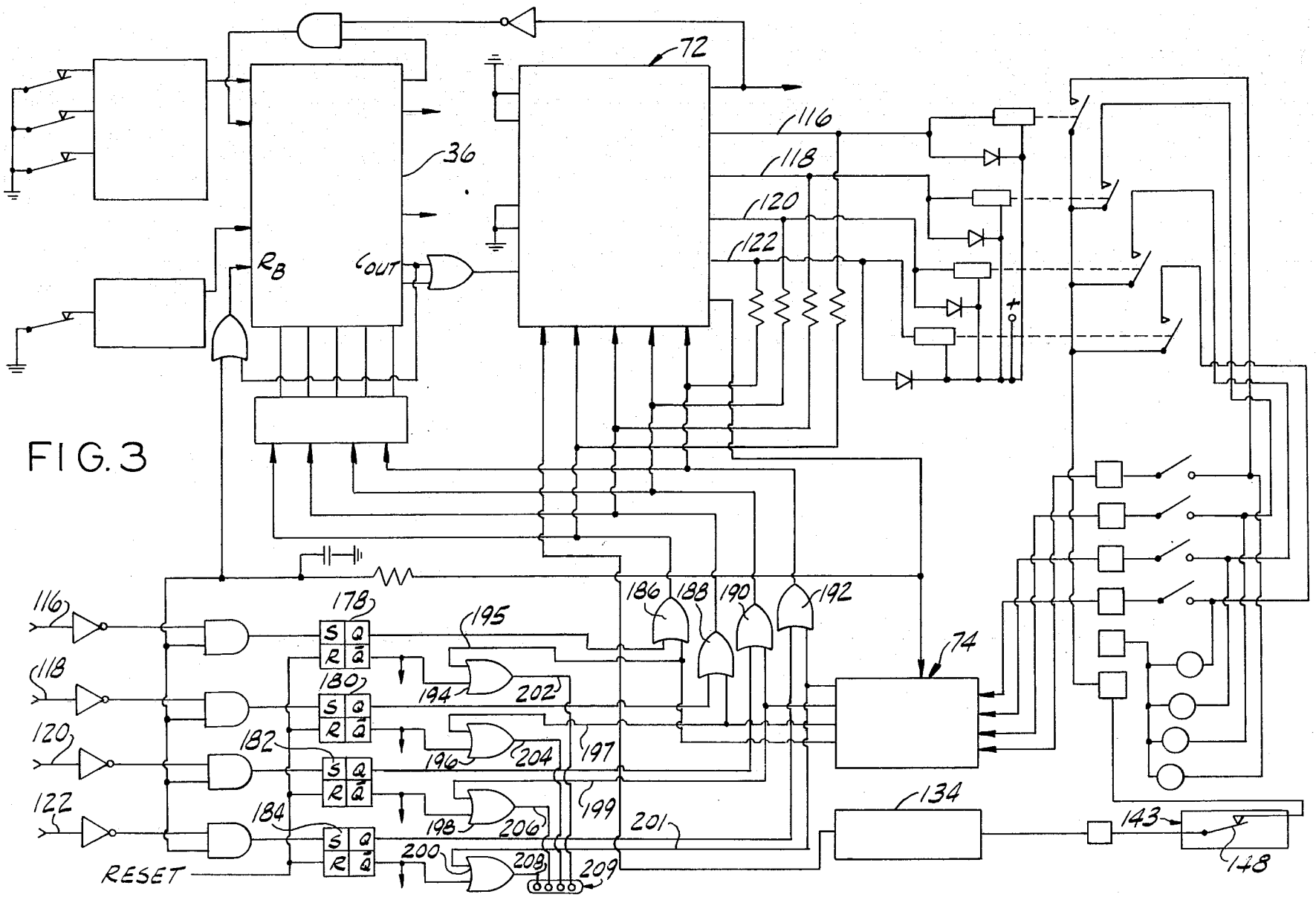

FIG. 3 is similar in most respects to FIG. 2 but has additional OR gate circuits 194, 196, 198 and 200 which are connected respectively to the $\bar{Q}$ outputs of the flip-flops 178–184. The OR gates 194–200 have respective output connections 202–208 which can be used for various purposes such as to energize an indicator of some kind by way of one or more of the terminals 209, to indicate the lack of availability of certain products, or to provide other information such as when a particular product ran out and so forth. This is accomplished for example, by a low condition occuring on one or more of the leads 202, 204, 206 and 208 to indicate the sold out condition. This occurs when the Q output of the respective flip-flops 178–184 is low from a previous failure and a selection is made as represented by a low on one of the leads 195, 197, 199 and 201.

FIG. 4 shows how the subject improvements can be incorporated for use generally in vendor control systems such as vendor control system 250 which has selection means 252 connected thereto. The selection means 252 may include individual selection switches or some other means for selecting each of the various products that can be vended. The selection means 252 are shown connected to the vendor control system 250 through a plurality of associated OR gates 254, 256, 258 and 260 which have other inputs connected from an empty product memory circuit 262 which receives inputs from the output of the vendor control system 250 on leads 264, 266, 268 and 270. The empty product memory 262 also has a set control input 272 which is connected to the output of delivery timer circuit 274. The timer circuit 274 may be similar in construction to the timer circuit 161 described above which is formed by the resistor 150 and the capacitor 151. The timer circuit 274 also has a connection on lead 275 from the vendor control system 250. Many other types of timer devices can also be used and are available for the present device including timers such as oscillator-counter type timers to name one type.

The outputs of the vendor control system 250 are connected to vend delivery means 276 which may include vend solenoids, relays, motors or other devices which when energized, operate to deliver a selected product to the customer. The vend delivery means may include a passageway, a chute or some other mechanism down which or through which the vended products pass as they are delivered to the customer. This passageway includes a delivery sensor element 278 which is located to produce a response, each time a product passes. The sensor may include a mechanical or electromechanical switching device, a magnetic sensor device, an optical detector device, an accoustic detector means, a piezo-electric detector or some other suitable product sensor. When the sensor is activated by a product being delivered, a change occurs on lead 280 which is applied to the VEND OFF control 282 of the vend control system 250. If one of the OR gates 254–260 is receiving an input from the product empty memory 262 at a time when its associated selection means are actuated by a customer, the vendor control system will not receive a selection signal at that position for reasons already stated.

The outputs of the vendor control system 250 that are connected as inputs to the item empty memory circuit 262 and to the vend delivery means 276 assure that whenever the vend delivery means 276 are actuated but fail to produce a vend by delivering a product within the time period established by the timer circuit 274, the vend delivery sensor means 278 will cause or fail to cause a response to be present on lead 280. Usually a response occurs because a product passes and actuates a sensor of some type such as described. If no response is delivered the recognition of this is then used to prevent further vend operations from being initiated for the particular product that failed to be delivered. This then causes a response on lead 272 which is applied to the product empty memory 262 to set the memory so that future selection of an unavailable product will not result in a loss to the customer. The circuit of FIG. 4 is included to show in a more generalized form the connections and interrelations between the various circuits and circuit portions of the present invention. This simplified block diagram will also make it easier to understand how the structural and operational principles of the present invention can be adapted for use in a large number of existing vend control systems and devices. It should also be recognized that the timer means as well as other circuit portions shown can be incorporated with or made as a part of the vendor control system, if desired.

FIG. 5 is a functional flow chart for the subject system illustrating how the subject improvements are adapted for use with an even more total electronic control circuit for a vending machine than has been possible heretofore, as for example for use with a microprocessor or like construction. The description of FIG. 5 is related to the circuit shown in FIG. 4. When a particular product is selected by operating a switch, a key or a button in the selection means 252, a response will have been produced in the item empty memory control circuit 262 which either enables other responses to be produced to produce a vend operation or to prevent vend because of a previous failure of a vend delivery operation. This is indicated on the flow chart by the possibilities of YES (Y) and NO (N) outputs. A YES response means that a selected vend cannot take place for some reason. The YES response will also energize the Selection Sold Out indicator means and no price will be entered and no deduction of the vend price from the amount deposited will occur. If, on the other hand, a NO response is present at the Item Empty means, meaning that there are items available, then the vend price of the selected item will be entered in the means labeled Credit≧Item Price. If the vend price entered is greater than the credit entered, a NO output will energize means labeled Insufficient Credit. If the amount of credit entered equals or exceeds the vend price than a YES output will be applied to the Start Delivery timer and to the Vend "ON" means to initiate a vend delivery operation. During the timer interval the Delivery Sensor 278 will sense whether or not a product is actually delivered. If a product delivery is sensed during the time interval, the Vend Off and refund of the excess credit will be actuated to terminate the vend operation and payout the amount of excess credit that was deposited or otherwise entered. If no product delivery is sensed by the sensor means 278 during the delivery time interval, this will be indicated by a YES output from the Time Up means and will cause the vend price previously entered to be reset so that the customer will not lose the cost of the vend price. The same YES output of the Time Up means will be used to set the Item Empty means for the particular product that was selected but failed to deliver to prevent further selections of that product.

It is important to note with respect to FIG. 5 that all of the various functions and operating decisions, some of which depend on one or more other operational functions, can be embodied in a relatively simple electronic device such as in an integrated circuit chip sometimes also referred to as a microprocessor. This is possible with the present construction because all, or nearly all, of the possible conditions that can occur are decision type conditions which require little or no hardware except for the decision making circuitry. This is because many of the more usual type mechanical or electromechanical devices such as motor operated cam switches and the like are not present or needed in the subject construction.

Thus, there has been shown and described novel means for improving the operation and increasing the versatility of vending and like machines including novel means which eliminate many of the more costly and more troublesome mechanical and electromechanical devices which have been used in the controls for vending machines in the past. These improvements greatly reduce the possibility for cheating a customer of a vending machine while at the same time they increase the versatility of such machines, and fulfill all of the other objects and advantages sought therefor. It will be apparent to those skilled in the art, however, that many changes, modifications, variations and other uses and applications of the subject means are possible and all such changes, modifications, variations and other uses and applications which do not depart from the spirit and scope of the invention are deemed to be covered by the invention which is limited only by the claims which follow.

What is claimed is:

1. A control circuit for a vending or like machine comprising a vendor control system including means for entering credit, means for selecting a particular vend at a particular vend price, vend producing means including means for energizing the vend producing means to deliver a product to the customer, sensor means located on the vending machine in a position to respond to the occurrence of any vend delivery produced thereby, said delivery sensor means including means for enabling a control response to be applied to the vendor control system whenever a vend delivery is initiated but is ineffective for some reason, means responsive to said control responses to enable the customer to select another vend or to be able to receive a refund of the credit he has entered, and means to inhibit future selection by a customer of a product that was selected but has failed to be delivered during a vending operation for some reason.

2. The control circuit for a vending or like machine defined in claim 1 wherein the vend delivery sensor means includes a passageway through which all vended articles pass, and means located adjacent to said passageway in position to respond to the passage of every product vended therethrough.

3. The control circuit defined in claim 1 including means to individually indicate on a multi-product vending machine those products which are unavailable for selection for some reason.

4. Improvements in control circuits for multi-selection vending machines which include credit entry means, accumulator means for entering the credits entered during each vending operation, selection means operable by a customer to select a particular vend when an amount of credit entered at least equals the vend price of the selected vend, a plurality of vend motors energizable selectively to cause a selected vend to be produced, and means to refund amounts credited in excess of the selected vend price, the improvement comprising means to establish a predetermined time interval commencing when a vend operation is initiated, a sensor device positioned to sense each product delivery as it occurs and to produce a response therefor, means responsive to occurrence of a sensor response during said predetermined time interval to enable subtracting of the cost of a product vended from the amount of credit entered and initiate a payback operation if the credit entered exceeds the cost of the vended product, and other means to prevent subtracting the cost of a vended product if the sensor device does not produce a response during the predetermined time interval.

5. In a multi-product vend control circuit having a vend selection means including means to select different vends at the same or at different costs, means for depositing credit entries and means for accumulating the amount deposited during each vend operation, means for initiating a vend delivery operation whenever the amount of credit entered at least equals the cost of a selected vend, means for establishing a predetermined time interval during which delivery of a selected vend is expected to take place, sensor means located to respond to the delivery of each product as it occurs, means to deduct from the credit amount deposited the amount of each product that is delivered at the conclusion of each predetermined time interval when a vend delivery is sensed by the sensor means, means to prevent deduction from the credit amount deposited during a vend operation if the sensor means do not sense the delivery of a product, and means to prevent enabling of future vends of a product that has failed to be delivered and be sensed.

6. In the multi-product vend control circuit of claim 5, the addition of means to provide information as to each product that fails to deliver.

7. In the multi-product vend control circuit of claim 5 wherein the sensor means includes a normally closed switch which opens when a vend delivery is sensed.

8. In the multi-product control circuit of claim 5, the sensor means include optical sensor means.

9. In the multi-product control circuit of claim 5, the sensor means include magnetic sensor means.

10. In the multi-product control circuit of claim 5, the sensor means include mechanical sensor means.

11. In the multi-product control circuit of claim 5, the sensor means include electromechanical sensor means.

12. In the multi-product control circuit of claim 5, the sensor means include accoustic sensor means.

13. In the multi-product control circuit of claim 5, the sensor means include piezoelectric sensor means.

14. A control logic circuit for a vending machine having credit entry means, means to accumulate the amount of credit entered during each vending operation, means to select a particular vend at a particular vend price, operator means actuable when the credit entered at least equals the vend price of a selected vend to cause a vend cycle to take place, and means to deduct from the credit entered the vend price whenever a product is delivered, the improvement comprising means forming a path along which all products are delivered to the customer, sensor means located along said path means in position to respond to the passage of each product as it is delivered, circuit means operatively connected to said sensor means and to the means to deduct the vend price from the credit entered, means to initiate a timing cycle of predetermined duration which is long enough to cover the time required to deliver a product each time a vend operation is initiated, means including said sensor means to prevent deduction of the vend price from the credit entered whenever the sensor means fails to sense the passage of a product during the timing cycle, and means operable when a vend operation is initiated for a particular product but no product is delivered to prevent future effective selections of the vend that failed.

15. The control logic circuit of claim 14 including means to reset the vend price entry means after each vend cycle when no product delivery is sensed.

16. The control logic circuit of claim 14 wherein the means to initiate a timing cycle of predetermined duration includes a resistor-capacitor circuit.

17. The control logic circuit of claim 14 including means to indicate vends that are unavailable for selection.

18. The control logic circuit of claim 14 wherein the sensor means includes normally closed switch means which open in response to sensing of a product delivery.

19. The control logic circuit of claim 14 wherein the means to initiate a timing cycle of predetermined duration includes an oscillator-counter circuit.

20. The control logic circuit of claim 14 wherein the means to initiate a timing cycle of predetermined duration includes a thermal control circuit.

21. A vend control logic circuit comprising a vend control system having at least two operator actuable selection means connected thereto and means for entering credit amounts therein, means energizable to deliver a product to a customer whenever the customer actuates one of the selection means at a time when the amount of credit entered at least equals the price of the selected vend, means responsive to energizing of the product delivery means to establish a time period during which the selected product should be delivered to the customer if it is going to be delivered, a sensor device positioned to sense the passage of every product delivered to the customer, circuit means operatively connected to said sensor device, said circuit means including a first portion operable to deduct from the credit entered the price of each selected product when the product during delivery is sensed by the sensor device, and a second portion to inhibit deducting the vend price from the credit entered when the sensor device does not sense a product being delivered during the established time period, and means responsive to operation of the second circuit portion to prevent future selections of a product that fails to be delivered.

22. A process for controlling the functional operations of a vending machine that has means for accepting and for accumulating credit, means for selecting particular vends at established vend prices and means for energizing corresponding vend delivery means operable when energized to cause a product to be delivered to the customer, a sensor located to sense the delivery of every product vended from the machine, the process including means to process signals produced during a vending operation including the steps of, responding to the entering of credit into the vending machine and to selections by a customer which do not exceed in price the amount of the credit entered, producing a timing period of predetermined duration each time a vend cycle is initiated, distinguishing between timing periods when a product delivery is sensed and when no product delivery is sensed and using this information to prevent loss of credit to the customer and to prevent future selections of products which fail to deliver when selected for some reason, and establishing the availability of each different type of product that can be vended from the vending machine.

* * * * *